US008021109B2

(12) United States Patent
Kneeland et al.

(10) Patent No.: US 8,021,109 B2
(45) Date of Patent: Sep. 20, 2011

(54) TURBINE CASING WITH FALSE FLANGE

(75) Inventors: Andrew R. Kneeland, Simpsonville, SC (US); Stephen C. Chieco, Greenville, SC (US); George Frey, Greenville, SC (US); Christopher Cox, Greenville, SC (US)

(73) Assignee: General Electric Company, Schenectady, NY (US)

( * ) Notice: Subject to any disclaimer, the term of this patent is extended or adjusted under 35 U.S.C. 154(b) by 892 days.

(21) Appl. No.: 12/028,865

(22) Filed: Feb. 11, 2008

(65) Prior Publication Data

US 2009/0185898 A1 Jul. 23, 2009

Related U.S. Application Data

(63) Continuation-in-part of application No. 12/017,396, filed on Jan. 22, 2008.

(51) Int. Cl.
*F01D 25/24* (2006.01)
*F28F 1/40* (2006.01)

(52) U.S. Cl. ..... 415/178; 415/214.1; 165/181

(58) Field of Classification Search ..... 415/177, 415/178, 214.1, 232, 213.1; 165/133, 181, 165/182, 185, 80.3
See application file for complete search history.

(56) References Cited

U.S. PATENT DOCUMENTS

| | | | | |
|---|---|---|---|---|
| 2,961,150 | A * | 11/1960 | Pirtle | 417/352 |
| 4,303,371 | A * | 12/1981 | Eckert | 415/116 |
| 4,363,599 | A * | 12/1982 | Cline et al. | 415/136 |
| 4,550,562 | A * | 11/1985 | Rice | 60/772 |
| 5,167,488 | A * | 12/1992 | Ciokajlo et al. | 415/175 |
| 5,240,070 | A * | 8/1993 | Ryan | 165/184 |
| 5,605,438 | A | 2/1997 | Burdgick et al. | |
| 6,273,675 | B1 * | 8/2001 | Magoshi et al. | 415/180 |
| 2006/0013681 | A1 * | 1/2006 | Cardarella | 415/1 |

* cited by examiner

*Primary Examiner* — Edward Look
*Assistant Examiner* — Liam McDowell
(74) *Attorney, Agent, or Firm* — Sutherland Asbill I& Brennan LLP

(57) ABSTRACT

A turbine casing may include an outer surface with a false flange and an inner surface with a heat sink positioned adjacent to the false flange.

18 Claims, 4 Drawing Sheets

TURBINE CASING WITH FALSE FLANGE

RELATED APPLICATIONS

The present application is a continuation-in-part of Ser. No. 12/017,396 entitled "Turbine Casing", filed on Jan. 22, 2008, and incorporated herein by reference in full.

TECHNICAL FIELD

The present application relates generally to gas turbines and more particularly relates to false flange heat sink features for a turbine casing that reduce "out of roundness" caused by thermal gradients.

BACKGROUND OF THE INVENTION

Typical turbine casings generally are formed with a number of sections that are connected to each other. The sections may be connected by bolted flanges in any orientation and in similar arrangements. During a transient startup of a gas turbine, the horizontal joints may remain colder than the rest of the casing due to the additional amount of material required to accommodate the bolt. This thermal difference may cause the casing to be "out of roundness" due to the fact that the time to heat up the horizontal joints may be slower than that of the surrounding casing. This condition is also called ovalization or "pucker". On shutdown, an opposite condition may occur where the horizontal joints remain hot while the casing around them cool off so as to cause the opposite casing movement or ovalization. Similar issues may arise with the use of one or more false flanges on the casing.

There is therefore a desire to reduce or eliminate the presence of thermal gradients that may cause an "out of roundness" about the joints or elsewhere about a casing for a rotary machine such as a turbine. Elimination of these thermal gradients should promote a longer lifetime for the equipment with increased operating efficiency due to the maintenance of uniform clearances therein.

SUMMARY OF THE INVENTION

The present application thus describes a turbine casing. The turbine casing may include an outer surface with a false flange and an inner surface with a heat sink positioned adjacent to the false flange.

The present application further may describe a turbine casing. The turbine casing may include a number of sections with a number of flange joints. The sections may include an outer surface with a false flange positioned on one or more of the sections. The sections may include an inner surface with a false flange heat sink positioned about the false flange on one or more of the sections.

The present application further describes a method of stabilizing a turbine casing having a number of sections with one or more false flanges positioned thereon. The method may include the steps of determining the average radial deflection of each section, subtracting the minimum radial deflection of each section, and adding a heat sink to one or more of the false flanges to reduce the average radial deflection of each section.

These and other features of the present application will become apparent to one of ordinary skill in the art upon review of the following detailed description when taken in conjunction with the several drawings and the appended claims.

DETAILED DESCRIPTION

Figure 1:
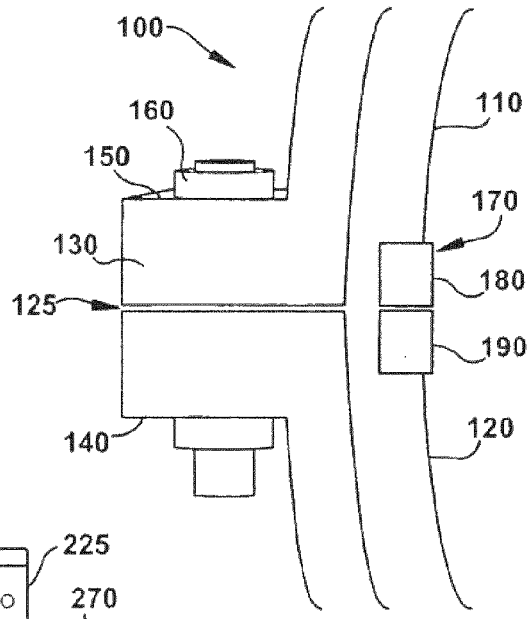
FIG. 1 is a perspective view of a bolted joint of a casing as is described herein.

Referring now to the drawings, in which like numerals refer to like elements throughout the several views, FIG. 1 shows a turbine casing 100 as is described herein. The turbine casing 100 includes an upper half 110 and a lower half 120. Other configurations also may be used herein. The upper half 110 may include a pair of upper half flanges 130 while the lower half 120 may include a pair of lower half flanges 140. When positioned adjacent to each other, the upper half 110 and the lower half 120 of the casing 100 meet at a joint 125. An aperture 150 extends through the flanges 130, 140 at the joints 125. The upper half 110 and the lower half 120 are connected via a bolt 160 that extends through the apertures 150 of the flanges 130, 140. Other connection means may be used herein.

The thermal responsiveness of the joints 125 of the casing 100 may be improved with the addition of a heat sink 170 positioned about the joints 125. Specifically, the heat sink 170 may be any parameterized geometric feature. The heat sink 170 may vary in any parameter such as height, width, length, elevation, taper, acuity, thickness, warpage, shape, etc.

In this example, the heat sinks 170 each may include an upper fin 180 positioned on the upper half 110 of the casing 100 opposite the upper half flange 130 and a lower fin 190 positioned on the lower half 120 opposite the lower half flange 140. The fins 180, 190 may extend slightly within the casing 110. The fins 180, 190 may be in contact or they may be separated by a predetermined distance. Separating the fins 180, 190 may reduce the possibility of the fins 180, 190 binding and stressing each other during thermal expansion or otherwise. The fins 180, 190 may be made of the same or a different material as that of the turbine casing 100. The fins 180, 190 may be welded, cast, or mechanically or otherwise attached to the casing 100. The fins 180, 190 serve to increase the surface area about the joints 125 so as to enhance the heat transfer by increasing the effective surface area. The fins 180, 190 may take any desired shape.

The use of the fins 180, 190 may reduce the "out of roundness" of the casing 100 for at least a portion of the startup time. Specifically, "out of roundness" is the average radial deflection minus the minimum radial reflection of the halves 110, 120 of the casing 100. Although the fins 180, 190 may reduce the "out of roundness" for a portion of the startup time, the fins 180, 190, however, may slightly increase the steady state "out of roundness". The fins 180, 190 again reduce the "out of roundness" during cool down. The size of the fins 190 and the heat sink 170 may be balanced against the thermal gradients and the "out of roundness" experienced by the casing 100. Larger heat gradients may require a larger heat sink 170 such that different sizes of the heat sinks 170 may be used.

Figure 2:
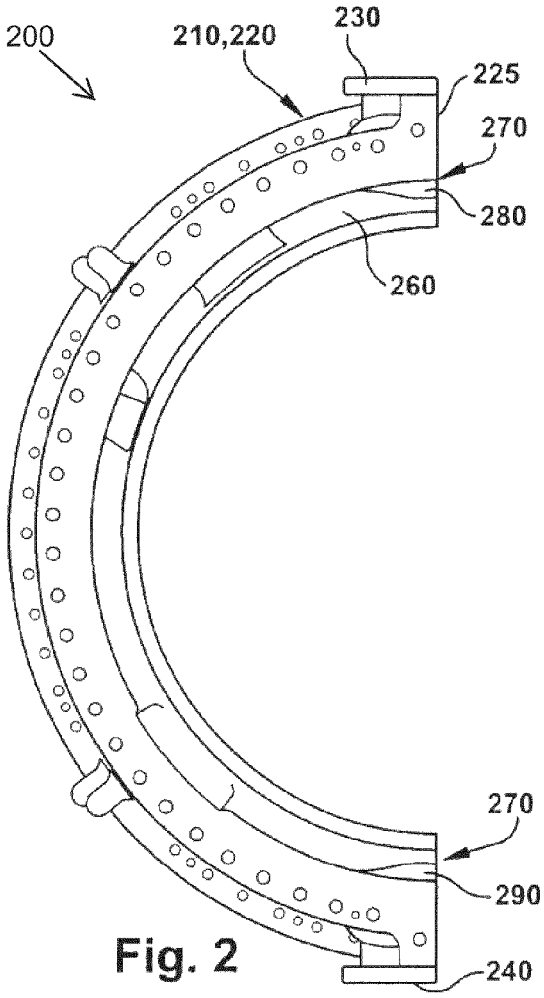
FIG. 2 is a side plan view of an alternative embodiment of a casing as is described herein.
Figure 3:
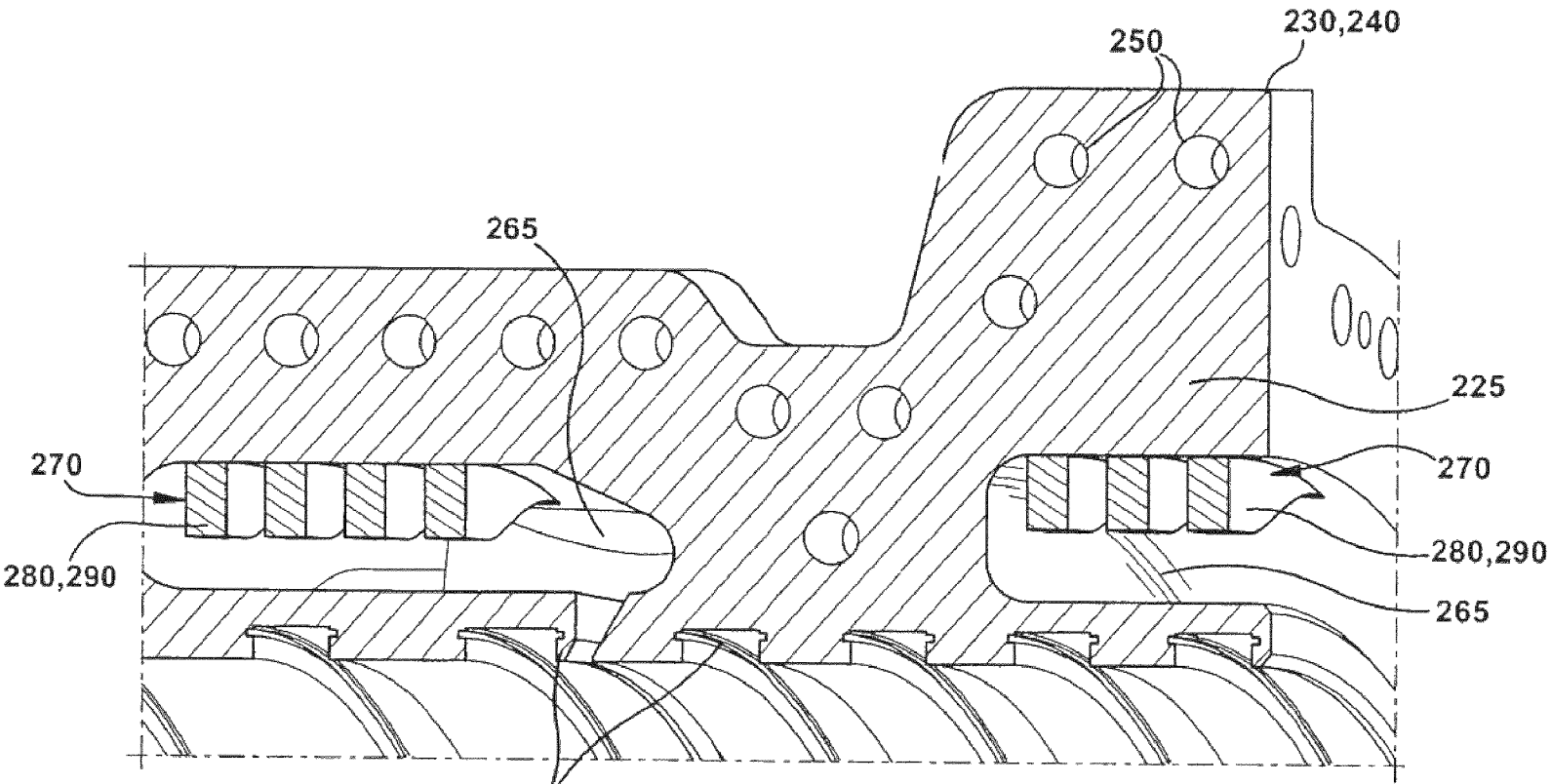
FIG. 3 is a side perspective view of the bolted joint of the casing of FIG. 2.

FIGS. 2 and 3 show a further embodiment of a turbine casing 200 as is described herein. As described above, the turbine casing 200 may include an upper half 210 and a lower half 220. Other configurations also may be used herein. Because the upper half 210 and the lower half 220 are substantially identical, only the upper half 210 is shown. Each end of the upper half 210 and the lower half 220 meet and are connected at a joint 225. The halves 210, 220 at the joints 225 may include a pair of upper half flanges 230 and a pair of lower half flanges 240. The flanges 230, 240 include a number of apertures 250 positioned therein. The halves 210, 220 of the casing 200 may be connected via the bolts 160 extending through the apertures 250 as described above or by other types of connection means.

The halves 210, 220 of the casing 200 may include a number of slots 260 positioned therein. The slots 260 may accommodate a shroud, a blade, a bucket, or other structures as may be desired. The halves 210, 220 of the casing 200 also may include a number of voids 265 positioned therein. These voids 265 may take the form of a recess along an outer edge of the casings 200 or the voids 265 may be positioned internally as may be desired.

The halves 210, 220 of the casing 200 also may include one or more heat sinks 270 positioned about the voids 265 adjacent to the joint 225. The heat sinks 270 may take the form of a set of upper fins 280 positioned about the upper half 210 of the turbine casing 200 and/or a set of lower fins 290 positioned about the lower half 220 of the casing 200. The fins 280, 290 may be positioned adjacent to the flanges 230, 240 of the joints 225. As is shown, the fins 280, 290 may vary in size with a larger area adjacent to the joints 225 and then decreasing in area as moving away from the joints 225. Alternatively, the fins 280, 290 may have substantially uniform shape. Any number of fins 280, 290 may be used. Any shape of the fins 280, 290 may be used. As described above, the heat sinks 270 as a whole may take any desired form.

The use of the heat sinks 170, 270 thus allows more heat to enter or leave the colder or hotter area about the joints 125, 225 and therefore improves the thermal response of the joints 125, 225 in relation to the remainder of the casing 100, 200. As a result, increased gas turbine and/or compressor/turbine efficiency may be provided due to better and more uniform clearances about the casing 100, 200. Reduction of the "out of roundness" also may mean less rubbing and repair costs on compressor blades, turbine blades, or other components.

Figure 4:
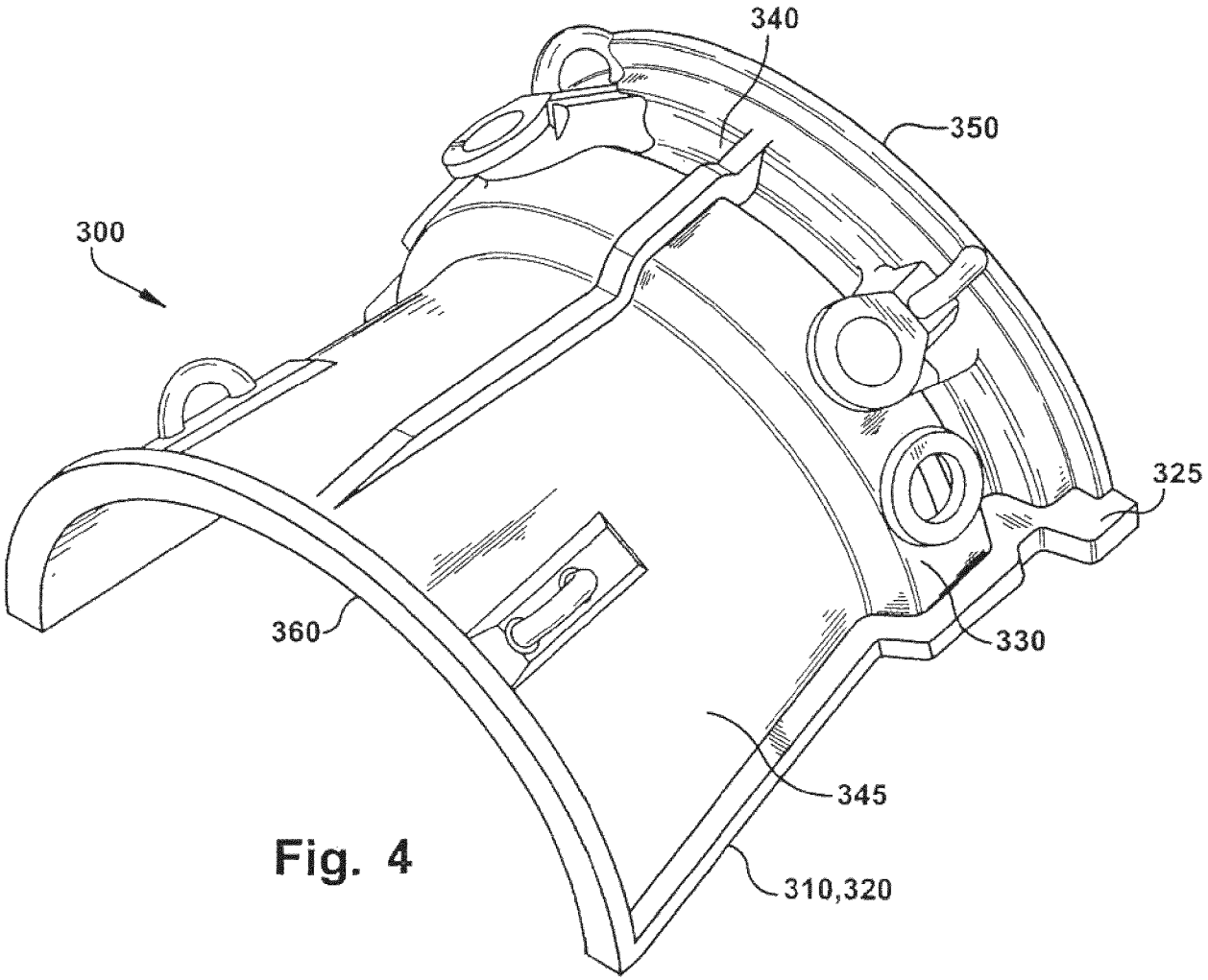
FIG. 4 is a perspective view of a casing with a false flange as is described herein.
Figure 5:
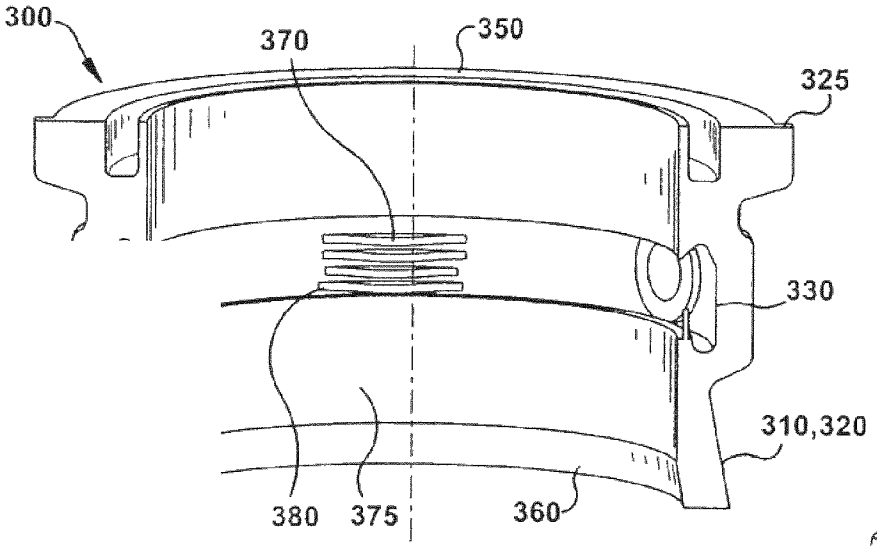
FIG. 5 is a plan view with cutaways of the casing of FIG. 4.
Figure 6:
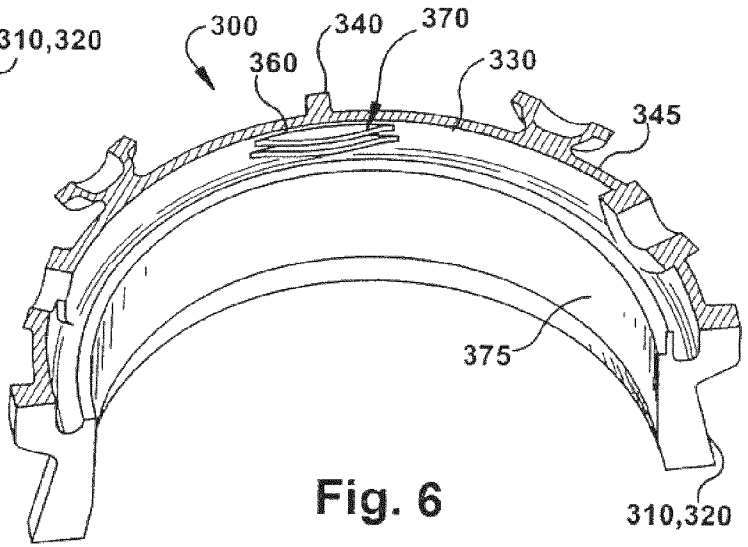
FIG. 6 is a plan view with cutaways of the casing of FIG. 4.

FIGS. 4-6 show a further embodiment of a turbine casing 300 as is described herein. Similar to those described above, the turbine casing 300 may include an upper half 310 and a lower half 320. Other configurations may be used herein. Because the upper half 310 and the lower have 320 are substantially identical, only one of the halves 310, 320 is shown. Each end of the upper half 310 and the lower half 320 meet in and are connected at a joint 325. The halves 310, 320 of the casing 300 may include a number of plenums such as a bleed plenum 330 or other types of raised features positioned therein.

The halves 310, 320 of the casing 300 also may include one or more false flanges 340 thereon. The false flange 340 may be in the form of a raised rib that extends axially on an outer surface 345 of the casing 300 from a first end 350 to a second end 360. The false flange 340 may be solid. The false flange 340 may vary in height as it extends from the first end 350 to the second end 360. The false flange 340 may match the stiffness and much of the thermal mass as is found at the joints 325. Other configurations may be used herein.

The halves 310, 320 of the casing 300 also may include one or more heat sinks 370 positioned about the plenum 330 and the false flange 340. The heat sinks 370 extend within the halves 310, 320 on an inner surface 375 of the casing 300 adjacent to the false flange 340. The heat sinks 370 may take the form of a set of fins 380. The fins 380 may have a substantially uniform shape or each fin 380 may vary in size. Any number of fins 380 may be used. Any shape of the fin 380 also may be used. As described above, the heat sinks 370 as a whole may take any desired form.

In a manner similar to the heat sinks 170, 270 at the joints 125, 225, the use of the heat sinks 370 allows more heat to enter or leave the colder or hotter area about the false flange 340 and therefore improves the thermal response of the false flange 340 in relation to the remainder of the casing 300. As a result, increased gas turbine and/or compressor/turbine efficiency may be provided due to better and more uniform clearances about the casing 300. The heat sinks 370 may be used on their own or in combination with the heat sinks 170, 270 described above.

It should be apparent that the foregoing relates only to the preferred embodiments of the present application and that numerous changes and modifications may be made herein by one of ordinary skill in the art without departing from the general spirit and scope of the invention as defined by the following claims and the equivalents thereof.

We claim:

1. A turbine casing, comprising:
an outer surface;
the outer surface comprising a solid false flange; and
an inner surface;
the inner surface comprising a heat sink positioned adjacent to the solid false flange for heat exchange between the heat sink and the solid false flange.

2. The turbine casing of claim 1, wherein the heat sink comprises one or more fins.

3. The turbine casing of claim 2, wherein the one or more fins are separated.

4. The turbine casing of claim 2, wherein the one or more fins comprise a uniform shape.

5. The turbine casing of claim 2, wherein the one or more fins comprise a plurality of shapes.

6. The turbine casing of claim 1, wherein the heat sink projects within the casing.

7. The turbine casing of claim 1, wherein the turbine casing comprises a plurality of sections meeting at a plurality of joints and wherein one or more of the plurality of joints comprises a joint heat sink.

8. A turbine casing, comprising;
a plurality of sections;
the plurality of sections comprising a plurality of flange joints;
each of the plurality of sections comprising an outer surface;
a solid false flange positioned on the outer surface of one or more of the plurality of sections; and
each of the plurality of sections comprising an inner surface;
a false flange heat sink positioned about the solid false flange on the inner surface of one or more of the plurality of sections.

9. The turbine casing of claim 8, wherein one or more of the plurality of sections comprises a joint heat sink positioned about one or more of the plurality of flange joints.

10. The turbine casing of claim 8, wherein the false flange heat sink and/or the joint heat sink comprise one or more fins.

11. The turbine casing of claim 10, wherein the one or more fins are separated.

12. The turbine casing of claim 10, wherein the one or more fins comprise a uniform shape.

13. The turbine casing of claim 10, wherein the one or more fins comprise a plurality of shapes.

14. The turbine casing of claim 10, wherein the one or more fins project within the casing.

15. A method of stabilizing a turbine casing having a number of sections with one or more false flanges positioned thereon, comprising:

determining the average radial deflection of each section;

subtracting the minimum radial deflection of each section; and adding a heat sink to one or more of the false flanges to reduce the average radial deflection of each section.

16. The method of claim 15, further comprising absorbing heat by the heat sink during turbine start up.

17. The method of claim 15, further comprising maintaining heat by the heat sink during turbine shut down.

18. The method of claim 15, wherein the number of sections meet at flange joints and wherein the method further comprises adding a flange joint heat sink to one or more of the flange joints.

* * * * *